United States Patent [19]

Hino et al.

[11] Patent Number: 5,077,138

[45] Date of Patent: Dec. 31, 1991

[54] FIBER REINFORCED MAGNESIUM ALLOY

[75] Inventors: Harumichi Hino; Mikiya Komatsu, both of Kanagawa; Yoshikazu Hirasawa, Tokyo; Shujiro Oki, Yamaguchi; Yoshitaka Ueda, Chiba, all of Japan

[73] Assignees: Nissan Motor Company, Limited, Yokohama; Ube Industries, Ltd., Ube, both of Japan

[21] Appl. No.: 530,574

[22] Filed: May 30, 1990

[30] Foreign Application Priority Data

May 30, 1989 [JP] Japan ..... 1-136619

[51] Int. Cl.[5] ..... C22C 32/00

[52] U.S. Cl. ..... 428/614; 428/649; 420/405

[58] Field of Search ..... 428/614, 649; 420/405

[56] References Cited

FOREIGN PATENT DOCUMENTS 0258178 3/1988 European Pat. Off. .
1354363 5/1974 United Kingdom .

OTHER PUBLICATIONS

Tumanov et al. "Composite materials based on light alloys" Chemical Abstract No. 89(24):202392c, 1978.
Hino et al. "Mechanical properties of alumina short fiber-reinforced magnesium-neodymium alloys", Chemical Abstracts 112(24):221694n, 1990, Feb.
Hino et al., "Effect of stressing during quenching upon the thermal . . . " Chemical Abstract No. 113(12):101723v, 1990, Jan.

*Primary Examiner*—R. Dean
*Assistant Examiner*—George Wyszomierski
*Attorney, Agent, or Firm*—Foley & Lardner

[57] ABSTRACT

A composite material having heat resistance at elevated temperatures and excellent mechanical properties to be used for parts of automotive vehicles, especially for pistons, machine parts or aerospace materials is composed of fiber reinforced magnesium alloy as a matrix having a composition of magnesium alloy containing up to 2 to 15 wt %, but preferably 4 to 7 wt % of neodymium or corresponding amount of neodymium-type metals, for example, didymium containing at least 70 wt % of neodymium. The composite material is composed of 70 to 95 vol % of the matrix and 30 to 5 vol % of short alumina fibers as the reinforcement.

8 Claims, 2 Drawing Sheets

FIBER REINFORCED MAGNESIUM ALLOY

BACKGROUND OF THE INVENTION

1. Field of the Invention

This invention relates in general to a fiber reinforced magnesium alloy as a material for automotive parts, machine parts or aerospace devices which are required to have heat resistance at elevated temperatures and to be lightweight, with excellent mechanical properties. The present invention relates more particularly to an alumina fiber reinforced magnesium alloy using alumina fiber as reinforcement and magnesium alloy as a matrix.

2. Description of the Prior Art

In recent years, the study of composite materials has become more and more advanced. There have been developed and utilized many composite materials such as fiber reinforced plastics (FRP), fiber reinforced ceramics (FRC) and fiber reinforced metals (FRM).

As in the case of fiber reinforced metals, some alloys which belong to so-called light metals such as aluminum alloy or magnesium alloy have been also used as a matrix. As for the latter, magnesium alloys such as MDC1A classified by JIS (AZ91A by ASTM standard), MC7 (ZK61A by ASTM standard) or MC8 (EZ33A by ASTM standard) and magnesium alloys such as AM60A, AS41A or QE22A classified by ASTM standard are supposed to have been available.

It is well known that alumina fibers are characterized by high strength, heat stability at high temperatures and low thermal expansion. Furthermore, manufacturing costs can be reduced when utilizing them as the reinforcement, because of their relative inexpensiveness.

However, composite materials, for example, formed by hot melt forging, generally exhibit low heat resistance when using alumina fibers as the reinforcement and the above magnesium alloys as the matrix alloy. Therefore, these alloys are not preferred for use at elevated temperatures such as 200° C. or over.

SUMMARY OF THE INVENTION

It is an object of the present invention to provide a short alumina fiber reinforced magnesium alloy having excellent mechanical properties and heat resistance at relatively high temperatures, for example, at least 200° C.

It is another object of the present invention to provide a short alumina fiber reinforced magnesium alloy having low thermal expansion.

The present invention has been achieved based on the following information recognized by the present inventors as a result of a variety of experiments and research on heat resistance and the mechanical properties of alloy composition. That is, the heat resistance and mechanical properties of alloys are highly improved when neodymium is contained in the magnesium alloy.

A short alumina fiber reinforced magnesium alloy is composed of 70 to 95 vol % of magnesium alloy consisting of 2 to 15 wt % of neodymium and the balance essentially of magnesium, and 30 to 5 vol % of short alumina fibers. More preferably, the magnesium alloy may contain 4 to 7 wt % of neodymium. The neodymium component may be composed of neodymium-containing metals such as didymiums containing at least 70 wt % of neodymium.

The magnesium alloy may contain at least one constituent selected from the groups consisting of less than 3 wt % of manganese, less than 1.5 wt % of yttrium, less than 5 wt % of samarium, less than 5 wt % of praseodymium, less than 5 wt % of gadolinium, less than 5 wt % of scondium, and less than 8 wt % of cerium. The cerium component may be composed of cerium-containing metals such as mischmetals containing at least 50 wt % of cerium. The magnesium component may contain a small amount of impurities which comprise a total of less than 0.5 wt % of zinc, silicon, iron, copper and/or nickel.

A process for forming a short alumina fiber reinforced magnesium alloy comprises the following steps; forming and placing alumina fiber preform, injecting molten magnesium alloy containing 2 to 15 wt % of neodymium and the balance essentially of magnesium into the fiber preform, saturating the alumina fiber preform with the molten alloy, and solidifying the magnesium alloy saturated alumina fiber preform.

According to the present invention, heat resistance and mechanical properties at relatively high temperatures are highly improved by the addition of neodymium to the matrix. Furthermore, when the matrix is reinforced by alumina fibers, the fabricated composite material exhibits high strength, stability at high temperatures and low thermal expansion resulting from the properties of the alumina fibers. The composite materials so obtained combine these characteristics by using magnesium alloy containing neodymium as the matrix and short alumina fibers as the reinforcement. Moreover, composites according to the present invention can be used in fabricating lightweight articles, and manufacturing costs can be kept low as alumina fibers are inexpensive.

BRIEF DESCRIPTION OF THE DRAWINGS

The present invention will be understood more clearly from the preferred embodiments described herebelow and from the appended drawings which illustrate detailed construction of the embodiments, which, however, should not be taken to limit the invention but are for explanation and understanding only.

In the drawings.

DETAILED DESCRIPTION OF THE PREFERRED EMBODIMENTS

Figure 1:
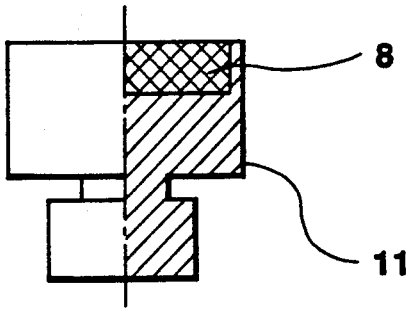
FIG. 1 is a right-half broken away side view of an article cast of short alumina fiber reinforced magnesium alloy according to the present invention.

In the present invention, the matrix magnesium alloy contains neodymium or corresponding neodymium-containing metals in a range from 2 to 15 wt %. Here, neodymium-containing metals may include didymium containing principally neodymium, by at least 70 wt %, purified from bastonaesite ore, for example, by the back extraction method. Furthermore, if required, the alloy may additionally contains at least one of the following: less than 3 wt % of manganese, less than 1.5 wt % of yttrium, less than 5 wt % of samarium, less than 5 wt % of praseodymium, less than 5 wt % of gadolinium, less than 5 wt % of scandium, less than 8 wt % of cerium or corresponding cerium-containing metals. Cerium-containing metals may be mischmetals containing principally cerium, by at least 50 wt %, purified from monozidte ore, for example, by the concentration method. The balance consists essentially of magnesium. The fiber reinforced magnesium alloy of the invention is composed of the above matrix of 70 to 95 vol % and the above reinforcement of 30 to 5 vol %. The composition example of didymium and mischmetal is shown in the following Table 1.

TABLE 1

| Composition example of didymium and mischmetal (wt %) | | |
|---|---|---|
| Elements | Didymium | Mischmetal |
| Nd | 72.3 | 18.2 |
| Pr | 7.9 | 6.4 |
| La | 8.8 | 22.6 |
| Ce | 0.8 | 50.6 |
| Cr | 0.75 | 0.03 |
| Si | 0.56 | 0.16 |
| Fe | 7.05 | 0.59 |
| Impurities | 1.84 | 1.42 |
| Sum of rare earth elements | 89.8 | 97.8 |

Additionally, the above magnesium may contains less than 0.5 wt % of impurities, such as zinc, silicon, iron, copper, nickel and so on.

When neodymium is contained in the alloy, it acts to increase the heat resistance and to improve the mechanical properties of the alloy. However, no desirable effects are obtained in amounts of less than 2 wt %. On the other hand, amounts exceeding the upper limit of 15 wt % causes embrittlement of the resulting alloy, and tend to cause breaking of the resulting composite materials at relatively small loads. Therefore, the preferred amount of neodymium in the magnesium matrix is determined in a range from 2 to 15 wt %, preferably from 4 to 7 wt %. Didymium as the neodymium-containing may be used, but in this case, the amount of didymium containing neodymium is determined in a range so as to provide enough neodymium to the magnesium alloy to be within the desired neodymium range of 2 to 15 wt %.

In the present invention, short alumina fiber tows are the most preferable reinforcing fiber. It is well known that short alumina fibers show high strength, high stability at high temperatures, and low thermal expansion. Moreover, it is relatively inexpensive fiber while compared with other reinforcing fibers. Generally, silicon dioxide ($SiO_2$) is contained in short alumina fibers. Silicon dioxide reacts with magnesium in the alloy and forms silicon according to the following reaction formula:

$$SiO_2+2Mg=Si+2MgO$$

However, silicon formed in this reaction acts to decrease the strength of the magnesium alloy containing neodymium. Therefore, short alumina fibers containing minimum amounts of silicon dioxide are preferred.

When the volume fraction (Vf) of short alumina fibers to magnesium alloy is less than 5 vol %, the reinforcing effect of short alumina fibers is insufficient to attain a substantial increase in strength and lower thermal expansion. On the other hand, the Vf exceeding the upper limit of 30 vol % causes large infiltration resistance when alumina fibers are immersed in molten magnesium alloy. Therefore, sound castings cannot be obtained easily, so it is preferably to determine the volume fraction of short alumina fibers in a range from 5 to 30 vol %. The strength of the composites proportionally increases along with Vf increases in the range of the above-mentioned amounts of short alumina fibers.

The present invention will now be described in further detail in the following examples including some examples for comparison.

EXAMPLES

Examples 1 to 5, Comparisons 1 to 5

Alloys of comparisons 1 to 5 were, according to the name of ASTM standards, AZ92, AZS1010 (manufactured by Ube Industries Ltd.), AS21, EX33A and QE22A, and alloys of examples 1 to 5 were Mg-5 wt % of Nd, Mg-5 wt % of Nd-1 wt % of Mn, Mg-5 wt % of Nd-1 wt % of Y, Mg-5 wt % of Nd-4 wt % of mischmetal, and Mg-4 wt % of Nd-2 wt % of Sm. Respective compositions of these comparisons and examples are shown in the following Table 2.

TABLE 2

| Compositions of magnesium alloys for the composite material matrix | | | | | | | | | | | | | |
|---|---|---|---|---|---|---|---|---|---|---|---|---|---|
| | | Alloy Elements (wt %) | | | | | | | | | | | |
| Sample | Alloy | Al | Zn | Si | Mn | MM* | Di** | Nd | Y | Sm | Ag | Zr | Mg |
| Comp. 1 | AZ92 | 9.1 | 2.0 | — | 0.25 | — | — | — | — | — | — | — | balance |
| Comp. 2 | AZS1010 | 9.3 | 0.6 | 0.59 | 0.19 | — | — | — | — | — | — | — | balance |
| Comp. 3 | AZ21 | 2.3 | 0.5 | 0.80 | 0.60 | — | — | — | — | — | — | — | balance |
| Comp. 4 | EZ33A | — | 2.5 | — | — | 3.2 | — | — | — | — | — | 0.6 | balance |
| Comp. 5 | QE22A | — | — | — | — | — | 2.5 | — | — | — | 2.1 | 0.5 | balance |
| Exam. 1 | Mg—5% Nd | — | — | — | — | — | — | 5.1 | — | — | — | — | balance |
| Exam. 2 | Mg—5% Nd—1% Mn | — | — | — | 0.80 | — | — | 4.9 | — | — | — | — | balance |
| Exam. 3 | Mg—5% Nd—1% Y | — | — | — | — | — | — | 4.7 | 1.2 | — | — | — | balance |
| Exam. 4 | Mg—5% Nd—4% MM* | — | — | — | — | 4.1 | — | 5.0 | — | — | — | — | balance |
| Exam. 5 | Mg—4% Nd—2% Sm | — | — | — | — | — | — | 4.2 | — | —8 | — | — | balance |

Comp.: comparison, Exam.: example
*Rare earth metals added by mischmetal addition
**Rare earth metals added by didymium addition On the other hand, short alumina fiber preforms (having about 100 mm diameter, 20 mm thickness, and about 10 vol % of Vf) were formed disc-like by the suction method in which short alumina fibers (manufactured by IMPERIAL CHEMICAL INDUSTRIES PLC; less than 5 wt % Si content) were suspended in water then suctioned. The direction of these fibers were arranged randomly parallel to the disc surface of the fiber preform.

Figure 2:
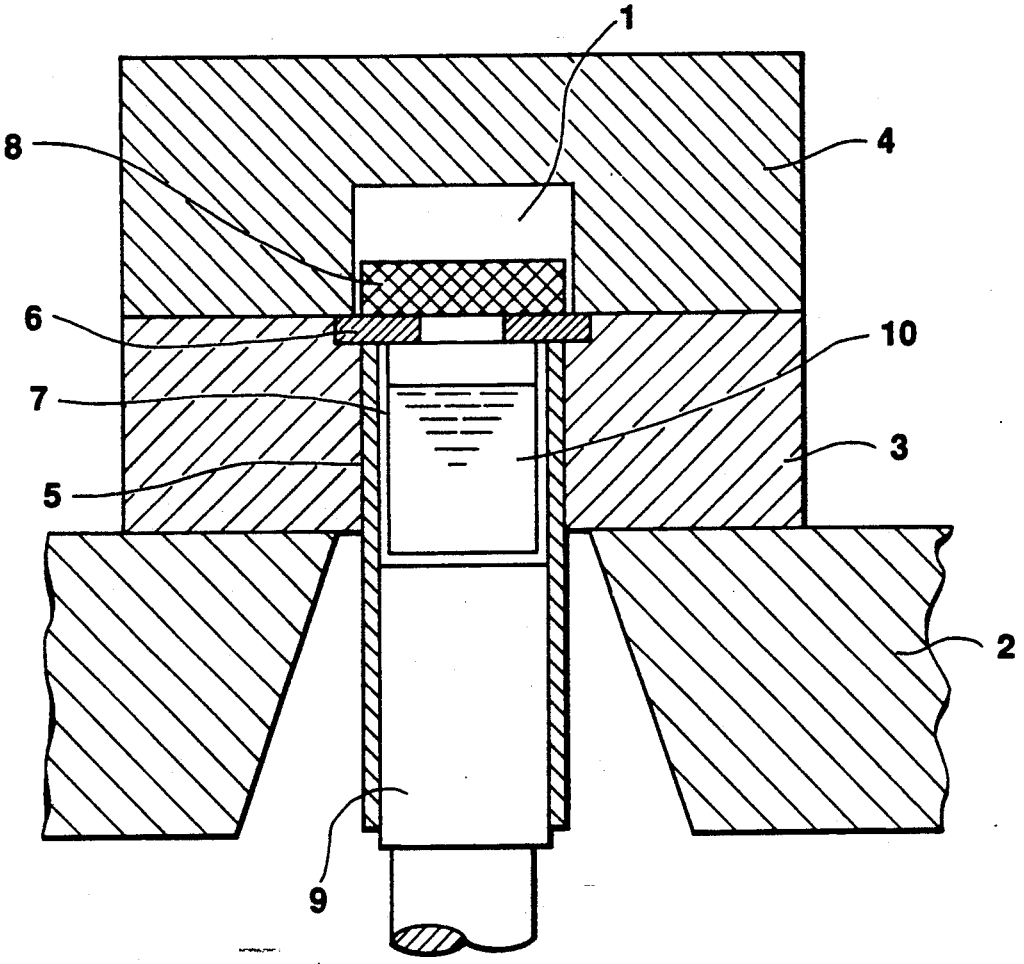
FIG. 2 is a partial sectional view of cavity of the vertical die cast machine used for casting the short alumina fiber reinforced magnesium alloy of the present invention.

Casting was performed using a vertical die cast machine having a diagrammatical structure as shown in FIG. 2. Referring now to FIG. 2, die cavity 1 is defined by a fixed mold 3 fixing to a platen 2 and a movable mold 4. Sleeve 5 is fixed within fixed mold 3. Core 6 is spaced on the upper end of the sleeve 5, and a plunger 6 is movable spaced to contact with ceramic paper (sold by the name of Fine Flex Paper) 7 fitted within the sleeve 5.

Molten magnesium alloy 10 having a composition as previously shown in Table 1 was supplied to the inside of the ceramic paper 7 within the sleeve 5. The die cavity 1 was opened by upwardly moving the movable mold 4, a dish-like preform of compressed short alumina fibers 8 was placed on the core 6, then the die cavity was closed by securing the movable mold 4 to the fixed mold 3. After the closing was completed, molten magnesium alloy 10 in the sleeve 5 was injected upwardly into the die cavity 1 by the plunger 9 to infiltrate the preform. The molten magnesium alloy 10 cast in the die cavity 1 and the saturated fiber preform 8 were solidified. Thus, casting article 11 formed of short alumina fiber reinforced magnesium alloy as previously shown in FIG. 1 was obtained. The casting conditions are shown in the following Table 3.

TABLE 3

| Casting Conditions | |
|---|---|
| Retaining Temperature of Molten Mg Alloy | 720° C. |
| Pre-heating Temperature of Short Alumina Fiber Preform | 600° C. |
| Injection Velocity | 40 mm/sec |
| Casting Pressure | 1000 kgf/cm$^2$ |
| Cavity Temperature | 150 to 250° C. |
| Lubricant | HITASOL (water soluble, Graphite-type Agent) |
| Die Closing Time | 45 seconds |
| Others | Using Core<br>Using Ceramic paper |

article 10 cast from short alumina fiber reinforced magnesium as shown in FIG. 1 were done. Test pieces were cut from the article 11 where the fiber preform 8 were coexisting, being parallel to the disc surface of the preform. Tensile test were done at 200° C. and creep rupture tests were done at 250° C. according to JIS, that is JIS G 0567 and JIS Z 2272, respectively. The results are shown in the following Table 4.

It will be noted from Table 4 that Examples 1 to 5 exhibited good tensile strength at 200° C. and good 0.2% yield strength, further to say excellent creep rupture strength at 250° C. compared with Comparisons 1 to 5. Furthermore, very little difference was found in the strengths of composites examples 1 to 5.

Examples 6 to 12, Comparisons 6 to 8, References 1 to 11

Disc-like short alumina fiber preform 8 comprising 10 vol % Vf prepared in examples 1 to 5 were placed on the core 6 in the cavity 1 previously shown in FIG. 2. Molten magnesium alloy 10 having compositions as shown in Table 5 were injected into the cavity 1 through the alumina fiber disc. Thus comparison 6, examples 6 to 12 and comparisons 7, 8, having shapes as shown in FIG. 1, were cast into articles of short alumina fiber reinforced magnesium alloy. Test pieces were cut out then tensile tests at 200° C. and creep rupture tests at 250° C. were done in the same manner as examples 1 to 5. The obtained results are shown in the following Table 6.

TABLE 4

Results of tensile test at 200° C. and creep rupture test at 250° C.

| | Alloy | Heating | Tensile Test: Tensile Strength (kgf/mm$^2$) | Tensile Test: 0.2% Yield Strength (kgf/mm$^2$) | Tensile Test: Elongation (%) | Creep Rupture Test *1 (rupture time: h): 5 kgf/mm$^2$ | 7 kgf/mm$^2$ | 10 kgf/mm$^2$ |
|---|---|---|---|---|---|---|---|---|
| C.1 | AZ92 | T6 *2 | 15.2 | 12.6 | 0.6 | 10 | 0.8 | — |
| C.2 | AZS1010 | T6 *3 | 17.4 | 13.5 | 1.7 | 43 | 0.1 | — |
| C.3 | AZ21 | F *4 | 14.1 | 11.9 | 0.6 | 78 | 3 | — |
| C.4 | EZ33A | T5 *5 | 16.5 | 12.0 | 3.4 | 160 | 21 | 0.7 |
| C.5 | QE22A | T6 *6 | 20.1 | 13.6 | 3.8 | 321 | 81 | 12 |
| E.1 | Mg—5% Nd | F | 22.1 | 15.7 | 2.3 | 889 | 129 | 23 |
| E.2 | Mg—5% Nd—1% Mn | F | 19.5 | 14.3 | 2.1 | 894 | 131 | 20 |
| E.3 | Mg—5% Nd—1% Y | F | 19.2 | 13.9 | 2.6 | 869 | 125 | 18 |
| E.4 | Mg—5% Nd—4% MM | F | 18.2 | 13.6 | 1.7 | 923 | 138 | 28 |
| E.5 | Mg—4% Nd—2% Sm | F | 20.4 | 14.8 | 2.7 | 811 | 117 | 13 |

C.: comparison, E.: example
*1: Rupture Time (h:hours)
*2: Quenching in water after 20 h. of retaining at 410° C., then air cooling after 5 h. of retaining at 220° C.
*3: Quenching in water after 20 h. of retaining at 415° C., then air cooling after 16 h. of retaining at 170° C.
*4: No heat treatment was performed after casting.
*5: Air cooling after 5 h. of retaining at 215° C.
*6: Quenching in water after 4 h. of retaining at 530° C., then air cooling after 8 h. of retaining at 204° C.

For reference purposes, articles were cast using molten magnesium alloy having a composition as previously shown in Table 5. These articles were not reinforced by any kind of fibers. Then tensile tests at 200° C. and creep rupture tests at 250° C. were preformed in the same manner as examples and comparisons 1 to 5. The obtained results are shown in Table 7.

Figure 3:
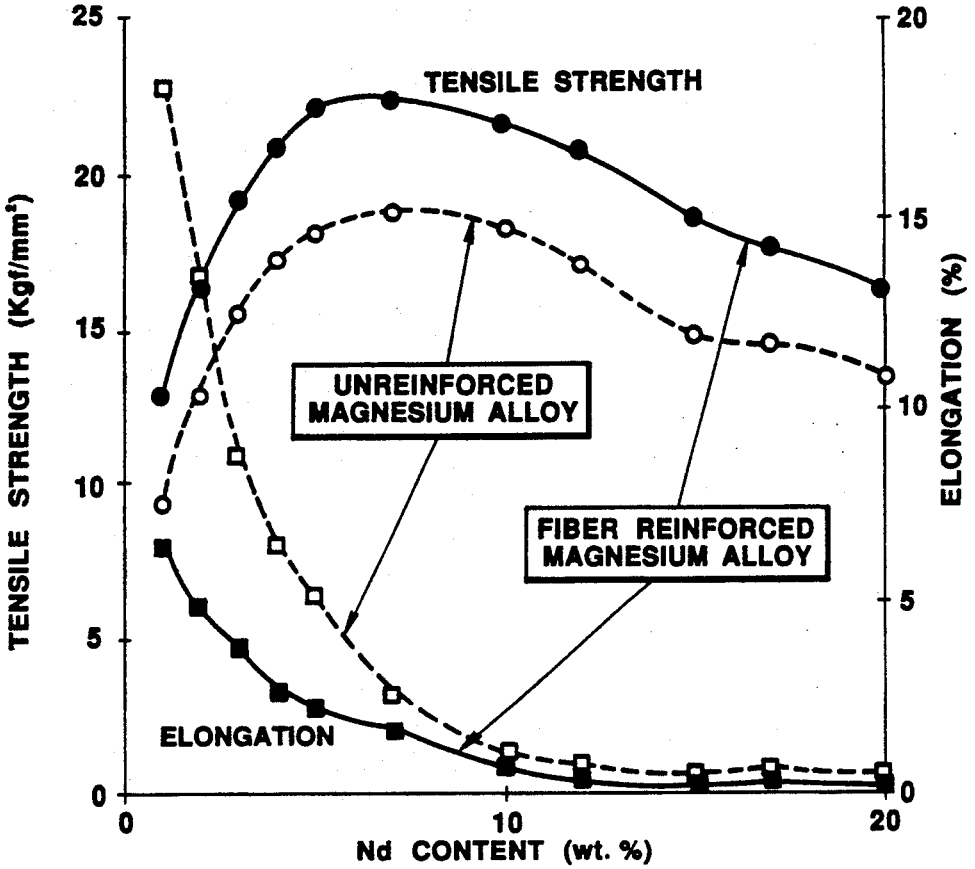
FIG. 3 is a graph showing the relationship between neodymium content in the magnesium alloy and tensile strength or elongation.

Furthermore, tensile strength and elongation obtained during the tensile tests were summarized and shown in FIG. 3.

TABLE 5

Magnesium Alloy Compositions

| Sample | Alloy | Composition (wt %): Nd | Mg |
|---|---|---|---|
| Comparison 6 | Mg—1% Nd | 0.9 | balance |
| Example 6 | Mg—2% Nd | 2.1 | balance |
| Example 7 | Mg—3% Nd | 2.9 | balance |
| Example 8 | Mg—4% Nd | 3.9 | balance |
| Example 1 | Mg—5% Nd | 5.1 | balance |
| Example 9 | Mg—7% Nd | 6.9 | balance |
| Example 10 | Mg—10% Nd | 9.5 | balance |
| Example 11 | Mg—12% Nd | 12.0 | balance |
| Example 12 | Mg—15% Nd | 14.8 | balance |
| Comparison 7 | Mg—17% Nd | 16.8 | balance |
| Comparison 8 | Mg—20% Nd | 19.6 | balance |

TABLE 6

Results of tensile tests (200° C.) and creep rupture tests (250° C.) of fiber reinforced magnesium alloy

| Sample | Alloy | Tensile Test: Tensile Strength (kgf/mm²) | Tensile Test: 0.2% Yield Strength (kgf/mm²) | Tensile Test: Elongation (%) | Creep Rupture Test (rupture time: h): 5 kgf/mm² | Creep Rupture Test (rupture time: h): 7 kgf/mm² | Creep Rupture Test (rupture time: h): 10 kgf/mm² |
|---|---|---|---|---|---|---|---|
| Comparison 6 | Mg—1% Nd | 12.8 | 6.3 | 6.4 | 182 | 3 | 0.1 |
| Example 6 | Mg—2% Nd | 16.4 | 9.9 | 4.9 | 364 | 10 | 0.2 |
| Example 7 | Mg—3% Nd | 19.2 | 12.4 | 3.8 | 550 | 25 | 2 |
| Example 8 | Mg—4% Nd | 20.8 | 14.8 | 2.7 | 698 | 62 | 8 |
| Example 1 | Mg—5% Nd | 22.1 | 15.7 | 2.3 | 889 | 129 | 23 |
| Example 9 | Mg—7% Nd | 22.4 | 16.5 | 1.3 | 1080 | 147 | 32 |
| Example 10 | Mg—10% Nd | 21.5 | 17.0 | 0.7 | 1350 | 162 | 36 |
| Example 11 | Mg—12% Nd | 20.8 | 18.0 | 0.4 | 1580 | 175 | 40 |
| Example 12 | Mg—15% Nd | 18.7 | 18.3 | 0.3 | 1820 | 180 | 43 |
| Control 7 | Mg—17% Nd | 17.8 | 17.4 | 0.3 | 1830 | 181 | 40 |
| Control 8 | Mg—20% Nd | 16.2 | 16.0 | 0.2 | 1860 | 185 | 39 |

TABLE 7

Results of tensile tests (200° C.) and creep rupture tests (250° C.) of unreinforced magnesium alloy

| Sample | Alloy | Tensile Test: Tensile Strength (kgf/mm²) | Tensile Test: 0.2% Yield Strength (kgf/mm²) | Tensile Test: Elongation (%) | Creep Rupture Test (rupture time: h): 5 kgf/mm² | Creep Rupture Test (rupture time: h): 7 kgf/mm² | Creep Rupture Test (rupture time: h): 10 kgf/mm² |
|---|---|---|---|---|---|---|---|
| Reference 1 | Mg—1% Nd | 9.4 | 4.3 | 18.2 | 9 | 0.1 | 0.0 |
| Reference 2 | Mg—2% Nd | 12.8 | 6.6 | 13.4 | 14 | 0.4 | 0.0 |
| Reference 3 | Mg—3% Nd | 15.5 | 8.4 | 8.7 | 21 | 1 | 0.1 |
| Reference 4 | Mg—4% Nd | 17.3 | 10.8 | 6.4 | 36 | 3 | 0.4 |
| Reference 5 | Mg—5% Nd | 18.2 | 12.8 | 5.2 | 50 | 7 | 1 |
| Reference 6 | Mg—7% Nd | 18.9 | 13.4 | 2.6 | 69 | 20 | 2 |
| Reference 7 | Mg—10% Nd | 18.3 | 13.7 | 1.1 | 94 | 34 | 5 |
| Reference 8 | Mg—12% Nd | 17.2 | 15.5 | 0.8 | 110 | 41 | 8 |
| Reference 9 | Mg—15% Nd | 14.9 | 14.5 | 0.5 | 138 | 53 | 12 |
| Reference 10 | Mg—17% Nd | 14.6 | 14.2 | 0.6 | 152 | 62 | 14 |
| Reference 11 | Mg—20% Nd | 13.5 | 13.4 | 0.5 | 173 | 75 | 17 |

It will be noted from FIG. 3 that good tensile strength and creep rupture strength was obtained among samples with neodymium contents ranging from 2 to 15 wt %, further excellent results were also obtained among samples with neodymium contents range from 3 to 12 wt %. Best results were obtained with neodymium contents ranging from 4 to 7 wt %. Additionally, slight difference between the curvature of reinforced and unreinforced magnesium alloy is found in FIG. 3, it seems that the fluidity of molten magnesium alloy is increased according to increased neodymium content.

formed in the same manner as example 1. Therefore, short alumina fiber preforms having the various Vf were prepared by suspending an appropriate amount of short alumina fibers in water then suctioning, and after suctioning, pressing if necessary then binding using alumina binder.

Figure 4:
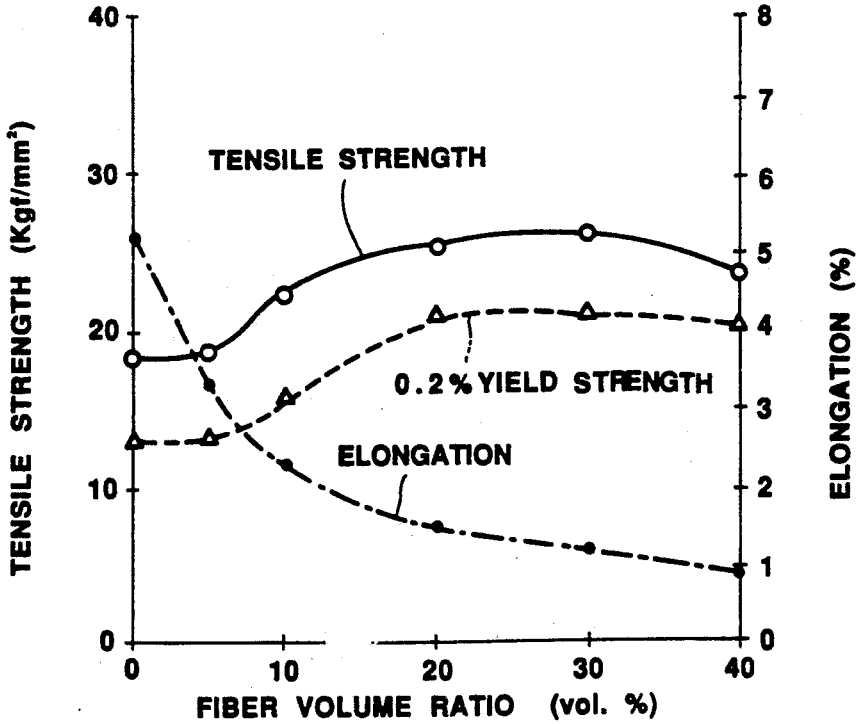
FIG. 4 is a graph showing the relationship between fiber volume fraction (%) in the magnesium alloy and tensile strength, 0.2% yield strength or elongation.

Test pieces were cut from each cast article 11 (but heat treatment was not performed), then these pieces were subjected to tensile tests at 200° C. and creep rupture tests at 250° C. The obtained results are shown in Table 8. and the results of the tensile tests are shown in FIG. 4.

TABLE 8

Results of tensile tests at 200° C. and creep rupture tests at 250° C. at various ranges of Vf

| Sample | Vf (vol %) | Tensile Test: Tensile Strength (kgf/mm²) | Tensile Test: 0.2% Yield Strength (kgf/mm²) | Tensile Test: Elongation (%) | Creep Rupture Test (rupture time: h): 5 kgf/mm² | Creep Rupture Test (rupture time: h): 7 kgf/mm² | Creep Rupture Test (rupture time: h): 10 kgf/mm² |
|---|---|---|---|---|---|---|---|
| Example 13 | 5 | 18.3 | 13.1 | 3.3 | 224 | 53 | 6 |
| Example 1 | 10 | 22.1 | 15.7 | 2.3 | 380 | 129 | 23 |
| Example 14 | 20 | 25.3 | 20.8 | 1.5 | 489 | 193 | 44 |
| Example 15 | 30 | 26.1 | 21.0 | 1.2 | 560 | 232 | 60 |
| Comparison 9 | 40 | 23.9 | 20.3 | 0.9 | 570 | 220 | 58 |

Examples 13 to 15

The preferred range of neodymium content was defined from the results of examples 6 to 12. In order to defined the preferable range of Vf, the following experiments were performed. Articles 11 were cast from short alumina fiber reinforced magnesium alloy using the alloy having composition of Mg-5 wt % Nd of example 1 as a matrix. Casting was performed in the same manner as example 1, except that short alumina fiber preforms of 5%, 10% (same volume as example 1), 20%, 30% and 40% Vf(vol %) instead of 10% Vf (vol %) were used. These short alumina fiber preforms were It will be noted from the results of Table 8 and FIG. 4 that the tensile strength of the cast articles was not increased when the Vf of short alumina fibers preform exceeded the upper limit of 30 vol %, and further to say, as at volume fractions exceeding the upper limit, magnesium alloy as a matrix cannot infiltrate short alumina fiber preforms easily, sound castings cannot be obtained. On the other hand, at a alumina short fiber Vf of less than 5 vol %, reinforcing effects cannot be obtained because the tensile strength is not so different from that of unreinforced alloy. Therefore, taking all of the above mentioned into consideration, the preferable range of the Vf is determined in the range of 5 to 30 vol %.

Although the present invention has been shown and described with respect to detailed embodiments thereof, it should be understood by those skilled in the art that various changes in form and detail thereof may be made without departing from the spirit and the scope of the appended claims.

What is claimed is:

1. A short alumina fiber reinforced magnesium alloy comprising;

70 to 95 vol % of magnesium alloy which contains 2 to 15 wt % of neodymium and the balance essentially of magnesium, and 30 to 5 vol % of short alumina fibers.

2. The short alumina fiber reinforced magnesium alloy as set forth in claim 1, wherein said magnesium alloy contains 4 to 7 wt % of neodymium.

3. The short alumina fiber reinforced magnesium alloy as set forth in claim 1, wherein said neodymium is present in the form of a neodymium-containing metal.

4. The short alumina fiber reinforced magnesium alloy as set forth in claim 3, wherein said neodymium-containing metal is didymium-containing at least 70 wt % of neodymium.

5. The short alumina fiber reinforced magnesium alloy as set forth in claim 1, wherein said magnesium alloy contains at least one constituent selected from the group consisting of: less than 3 wt % of manganese, less than 1.5 wt % of yttrium, less than 5 wt % of samarium, less than 5 wt % of praseodymium, less than 5 wt % of gadolinium, less than 5 wt % of scandium, and less than 8 wt % of cerium.

6. The short alumina fiber reinforced magnesium alloy as set forth in claim 5, wherein said cerium is present in the form of a cerium-containing metal.

7. The short alumina fiber reinforced magnesium alloy as set forth in claim 5, wherein said cerium-containing metal is a mischmetal containing at least 50 wt % of cerium.

8. The short alumina fiber reinforced magnesium alloy as set forth in claim 1, wherein said magnesium alloy contains a small amount of impurities selected from the group consisting of zinc, silicon, iron, copper and nickel, the total amount of the impurities being less than 0.5 wt %.

* * * * *